US005909969A

United States Patent [19]

Davison

[11] Patent Number: 5,909,969

[45] Date of Patent: Jun. 8, 1999

[54] FULL BODY SHOWER SYSTEM

[76] Inventor: Donald R. Davison, 359½ MacArthur Ave., Long Branch, N.J. 07740

[21] Appl. No.: 09/080,779

[22] Filed: May 18, 1998

[51] Int. Cl.[6] ..... A47K 3/20

[52] U.S. Cl. ..... 4/569; 4/567; 4/570

[58] Field of Search ..... 4/569, 568, 567, 4/570, 559, 597, 601, 605, 615

[56] References Cited

U.S. PATENT DOCUMENTS

| | | | |
|---|---|---|---|
| 430,253 | 6/1890 | Reid | 4/567 |
| 430,257 | 6/1890 | Taylor | 4/567 |
| 819,582 | 5/1906 | Newton | 4/567 |
| 1,112,261 | 9/1914 | Carter | 4/615 |
| 2,060,100 | 11/1936 | Michelson | 4/615 |

*Primary Examiner*—David J. Walczak
*Attorney, Agent, or Firm*—Robert M. Skolnik

[57] ABSTRACT

A full body shower system having three generally horizontal water dispensing portions or portions and two generally vertical closed portions or portions connecting the horizontal portions or portions. The maximum number of water spray apertures in the system is sixty. The apertures are located in the horizontal water dispensing portions or portions at angles with respect to the horizontal to direct water in a predetermined pattern.

8 Claims, 2 Drawing Sheets

FULL BODY SHOWER SYSTEM

BACKGROUND OF THE INVENTION

1. Field of the Invention

The present invention relates to shower systems and specifically to a full body shower system. The system includes an attachment for coupling it to an existing water source in a bathtub or in a shower and may be easily mounted on the wall so that it can be removed, after use. The system of the present invention may also be used to supplement an existing shower head using a valve to divert water from the head to the system.

2. Description of the Prior Art

Taylor, 432,712, and 439,793 show a shower system providing a number of water sources directed to different parts of the body and under separate control.

Clifford, et al., 475,754 relates to a system similar to Taylor, but having two wing sections which can fold out of the way when not in use.

Newton, 819,582 discloses another shower system similar to those of Taylor and Clifford et al., but which is removable mounted on the rim of a bathtub.

Dimond, 924,602, and Holmes, 944,611 show shower systems which provide three vertical sources of spray adjacent a flat tub wall above the tub's nozzle.

Ejchorszt, 3,858,252, discloses a shower attachment with a multi-position valve to direct water to various portions or sections of the attachment.

Ejchorszt, 3,984,879, discloses a "built in" multiple spray shower.

Bowden, 4,809,369, shows a plurality of linear tubular sections which can be connected together to form a single elongated spray head of desired length.

Daunt, 4,927,083, teaches variation of the spacing and location of the spray apertures to provide different volumes of water from a spray head to different locations.

SUMMARY OF THE INVENTION

The present invention is full body shower system having three generally horizontal water dispensing portions or sections and two generally vertical closed portions or sections connecting the horizontal portions or sections. These portions or sections may be constructed as a single unitary structure. Alternatively, one or more of the portions or sections may be formed individually and connected to the other portions or sections to form the system of the present invention. The maximum number of water spray apertures in the system is sixty. The apertures are located in the horizontal water dispensing portions or sections at angles with respect to the horizontal to direct water in a predetermined pattern.

The present invention connects directly to the existing water outlets provided in the bathroom such as the bathtub tap or the shower stalk. No special installation, valves or controls are needed. The existing hot and cold water valves provide the control to the shower system of the present invention. The present invention may also work with an existing shower head. A diverter valve is connected between the shower stalk and the existing head. The diverter valve thus directs water to either the existing shower head or to the system of the present invention.

The shower system is compact, easy to handle, and to mount onto the wall of a bath or shower. The height of a person is accommodated by providing several sets of mounting bracket at different heights on the wall. The shower system can be hung from these different height brackets thus raising or lowering the system.

A principal object of the present invention is the provision of full body shower system. Another object and advantage of the present invention is the provision of a full body shower system having sixty or less water dispensing apertures to control the pressure and spray pattern of the system. A still further object and advantage of the invention is the provision of full body shower system wherein the apertures are arrayed at angles from the horizontal to direct water to different parts of the body. Another object and advantage of the present invention is the provision of full body shower system having three horizontal water dispensing portions or sections and two vertical closed connecting portions or sections. Another object and advantage of the invention is the provision of a plurality of sets of mounting brackets affixed to a wall from which the invention can be mounted. A still further object and advantage of the invention is the provision of mounting brackets and different heights above the bottom of a bathtub or shower from which the invention can be mounted to accommodate persons of different heights.

Another object and advantage of the present invention is the provision of a full body shower system which can operate from existing bathtub or shower water outlets. A still further object an advantage of the invention is the provision of a full body shower system which uses the existing hot and cold water controls in the bathtub or shower.

BRIEF DESCRIPTION OF THE DRAWINGS

These as well as further objects and advantages of the invention will become apparent to those skilled in the art from a review of the following detailed description of our invention, reference being made to the accompanying drawings in which.

DESCRIPTION OF THE PREFERRED EMBODIMENTS

Figure 1:
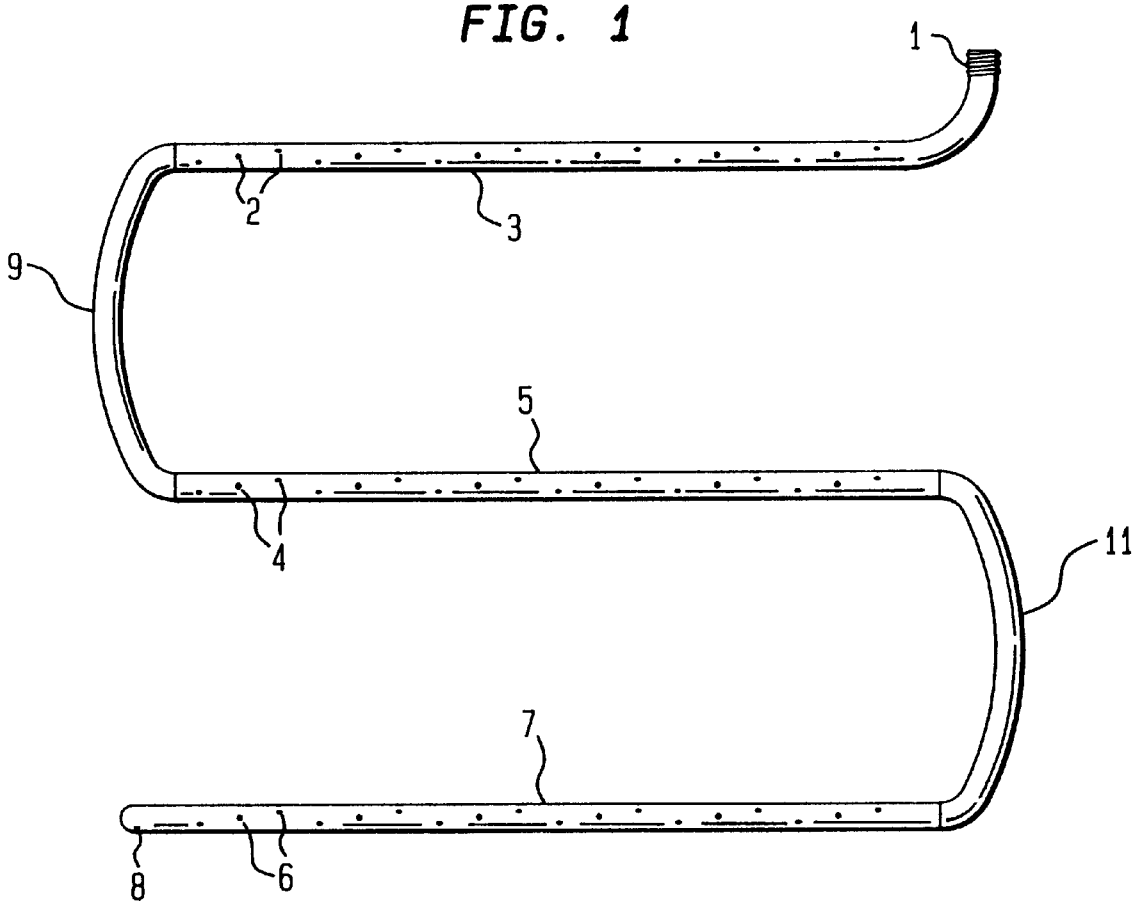
FIG. 1 is a side view of the invention.

As shown in FIG. 1, the full body shower system of the present invention includes 5 interconnected tubular sections. Three horizontal sections, 3, 5 and 7 have water spray apertures shown generally at 2, 4, and 6, respectively, formed therein. The horizontal section 3 is connected to section 5 with a vertical closed section 9. The horizontal section 5 is connected to horizontal section 7 by vertical closed section 11. The shower system is connected to a source of pressurized water at threaded end 1. A weep hole 8 is provided at the end of horizontal section 7 for drainage of fluid in all components of FIG. 1.

There are eighteen holes each in sections 3, 5 and 7. These holes may be located at different angles from the horizontal in each of the sections. I have discovered that the maximum number of holes in a device of this type is a total of sixty holes. This number of holes provides to the user water at the desired intensity and produces a spray pattern of the desired configuration.

Figure 2:
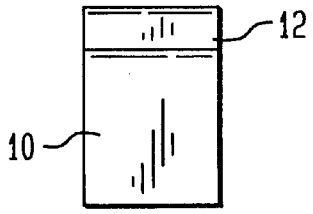
FIGS. 2–2A are front and side views, respectively, of a mounting bracket for the invention of FIG. 1.
Figure 2A:
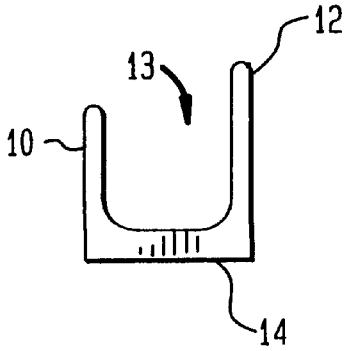

FIGS. 2–2A show the mounting bracket 13 to be employed for the embodiment of FIG. 1. The bracket is a U-shaped bracket having a back wall 12, a front wall 10 and a bottom wall 14.

Figure 3:
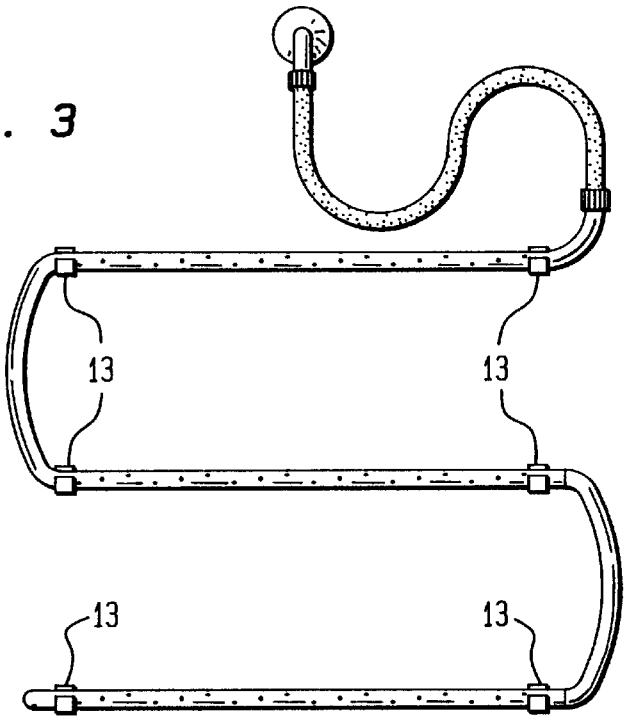
FIGS. 3–3A are diagrammatic views showing how a plurality of the mounting brackets of FIGS. 2–2A are arrayed for supporting the invention of FIG. 1.
Figure 3A:
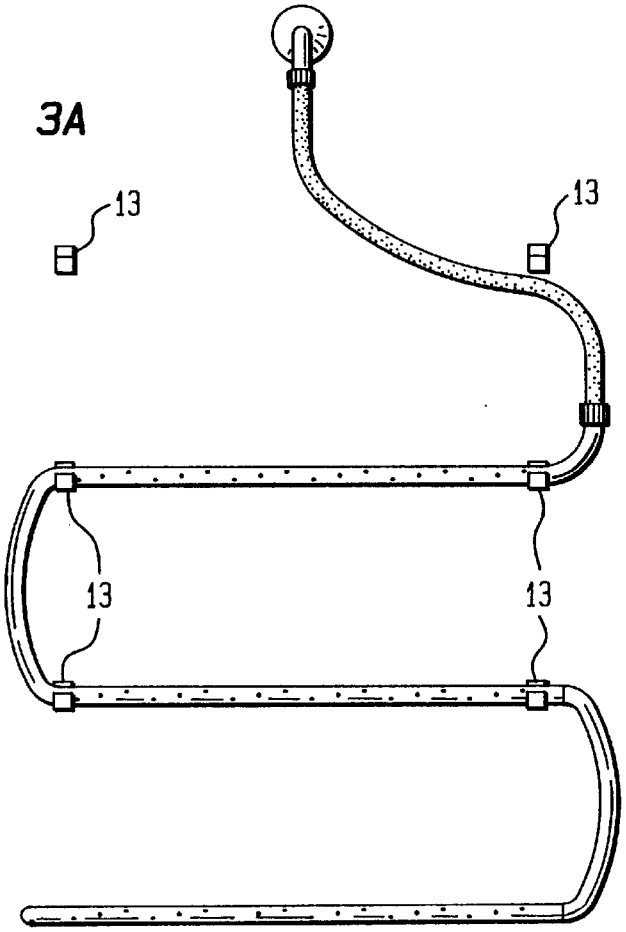

As shown in FIGS. 3–3A, three pairs of brackets 13 are mounted on a wall. In FIG. 3, the invention is hung between the uppermost pair and the middle pair of brackets 13. In FIG. 3A, the invention is lowered by hanging it from the middle and lower pairs of brackets 13. As can be seen, different heights for the invention can be established by the location of the pairs of brackets 13.

The invention may be attached to an existing water source in the shower or bath by using a flexible hose to be connected from the water source to the outlet 1 of FIG. 1. If desired, the existing shower system can be removed and the hose connected to the stalk of the shower. Alternatively, a valve may be connected between the stalk and the existing shower system to switch the flow of water from the existing shower system to the full body shower system of the present invention.

Further modifications to the method and apparatus of the invention may be made without departing from the spirit and scope of the invention; accordingly, what is sought to be protected is set forth in the appended claims.

I claim:

1. A full body shower system comprising: three generally horizontal spaced apart tubular portions, each of said horizontal tubular portions having two ends, and a plurality of apertures formed therein for permitting pressurized water to exit therefrom in a predetermined pattern; a first generally vertical tubular portion fluidly connecting one of said ends of said first of said generally horizontal tubular portions to one of said ends of said second of said generally horizontal tubular portions, a second generally vertical tubular section fluidly connecting the other of said ends of said second of said generally horizontal tubular portions to one of said ends of said third of said generally horizontal tubular portions, and means connected to the first of said generally horizontal tubular portions for connecting said full body shower system to a water source.

2. The full body shower system of claim 1 further including means in said third generally horizontal tubular section for draining fluid from all of said portions.

3. The full body shower system of claim 2 wherein the maximum number of apertures in said fully body shower system is sixty.

4. The full body shower system of claim 3 further including mounting means for supporting said shower system at different vertical positions.

5. The full body shower system of claim 4 wherein said mounting means includes a plurality of pairs of brackets.

6. The full body shower system of claim 1 wherein said portions are formed as a single unitary structure.

7. The full body shower system of claim 1 wherein at least one of said portions is formed as a single unitary structure for connection to the other of said portions.

8. A full body shower system comprising: three generally horizontal spaced apart apertured portions for dispensing pressurized water therefrom, each of said portions having two ends, first connecting means fluidly connected between an end of a first of said horizontal portions and an end of a second of said horizontal portions, and second connecting means fluidly connected between the other end of a second of said horizontal portions and an end of a the third of said horizontal portions, said connecting means not having any of said pressurized water apertures therein, the total number of pressurized water dispensing apertures not exceeding sixty.

* * * * *